United States Patent [19]

George

[11] 3,965,527

[45] June 29, 1976

[54] VACUUM GROOMING BRUSH

[76] Inventor: Ivor Prosser George, West Winds, Cilfrew, Neath, Glamorganshire, Wales

[22] Filed: Sept. 10, 1974

[21] Appl. No.: 504,797

[52] U.S. Cl. ..... 15/396; 15/400
[51] Int. Cl.[2] ..... A47L 9/06
[58] Field of Search ..... 15/393, 396, 398, 399, 15/400

[56] References Cited

UNITED STATES PATENTS

| | | | |
|---|---|---|---|
| 921,669 | 5/1909 | Boegel et al. | 15/399 X |
| 1,029,501 | 6/1912 | Horlacher | 15/402 X |
| 3,283,356 | 11/1966 | Fromknecht | 15/400 |

FOREIGN PATENTS OR APPLICATIONS

| | | | |
|---|---|---|---|
| 733,804 | 7/1955 | United Kingdom | 15/400 |

*Primary Examiner*—Leonard D. Christian
*Assistant Examiner*—C. K. Moore
*Attorney, Agent, or Firm*—Sughrue, Rothwell, Mion, Zinn & Macpeak

[57] ABSTRACT

A vacuum grooming brush for dogs comprises a brush head having a set of bristles extending from one side of the head and one or more vacuum inlet passages located between the bristles and the outer edges of the head, and connecting means for connecting the interior of the head to a source of vacuum.

3 Claims, 5 Drawing Figures

VACUUM GROOMING BRUSH

BACKGROUND OF THE INVENTION

1. Field of the Invention

This invention relates to brushes, and more particularly to vacuum brushes for grooming animals.

2. Description of the Prior Art

Vacuum brushes for grooming animals are known, and while the majority of these prior devices are relatively efficient when used on short-haired dogs, they are ineffective when used on dogs with long coats. This is because the vacuum inlet passages located around the bristles tend to draw the long hairs of the dog into the brush head, causing tangling of the hairs around the bristles and rendering the grooming operation impossible.

It is an object of the invention to provide a vacuum grooming brush which provides an effective grooming action without tangling the coat of the animal even when used on long-haired breeds of dog.

It is a further aim of the invention to provide a vacuum brush suitable for grooming dogs which is easy to use, which reduces the time required to groom a dog and which produces an improved result over conventional grooming means.

SUMMARY

According to the present invention there is provided a vacuum grooming brush, comprising a brush head, a set of bristles supported in and extending from one side of the brush head, one or more vacuum inlet passages formed in the side of the head which supports the bristles, and connecting means for connecting the or each vacuum inlet passage to a source of vacuum to cause suction around the bristles when the brush is in use, the or each vacuum inlet passage being located only in the marginal edge regions of the head between the bristles and the outer edges of the head.

The location of the vacuum inlet passages only around the bristles and not amongst the bristles allows the brush to be used on long hair without tangling occurring, and it has been found that not only does the brush result in a much improved brushing operation but the hair and skin of the dog is stimulated and this improves the condition and growth of the dog's coat. The operation of grooming a dog with the brush of the present invention is also a more pleasant operation for the user than grooming when using conventional dog brushes, as dust and dead hair is drawn into the head of the brush and not allowed to float freely in the atmosphere. This is of great benefit to dog owners who are asthmatics or who suffer from bronchitis or other chest complaints.

Preferably the side of the brush head supporting the bristles is provided around at least part of its periphery with a skirt extending in substantially the same direction as the bristles, and the or each vacuum inlet passage is located in the area between the skirt and the bristles. Advantageously, the brush includes a handle, one end of which is fixed to the brush head and the other end which is adapted to be connected to a domestic vacuum cleaner, and the connecting means comprises an axial bore formed in the handle communicating with the or each vacuum inlet passage.

In one embodiment of the invention, the brush head is hollow and the or each vacuum inlet passage communicates with the hollow interior of the head, the connecting means being adapted to connect the interior of the head to the source of vacuum. In another embodiment, the connection means comprises a suction inlet pipe which extends through one wall of the skirt and which is formed integrally with the handle.

Air flow directing means may be located in the interior of the brush head for promoting a venturi effect in the brush head during operation.

The skirt around the bristles may be of flexible material and may extend over between one third and one quarter of the length of the bristles.

In a preferred embodiment, the bristles are secured to a bristle holder which is detachably mounted on the brush head to allow different types of bristles to be substituted.

DESCRIPTION OF THE PREFERRED EMBODIMENT

Figure 1:
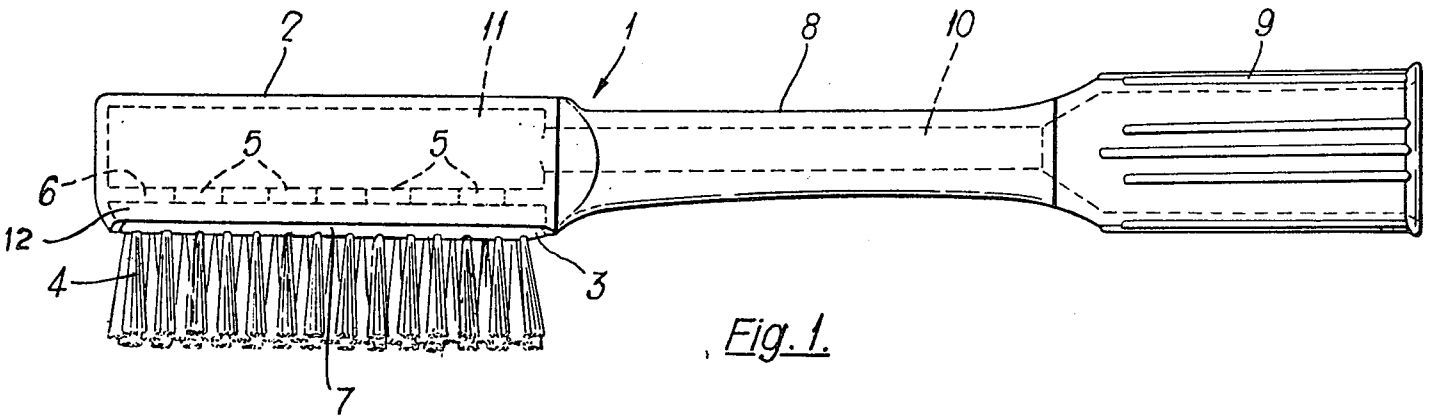
FIG. 1 is a side elevation of a hair brush suitable for grooming the coat of a dog.
Figure 2:
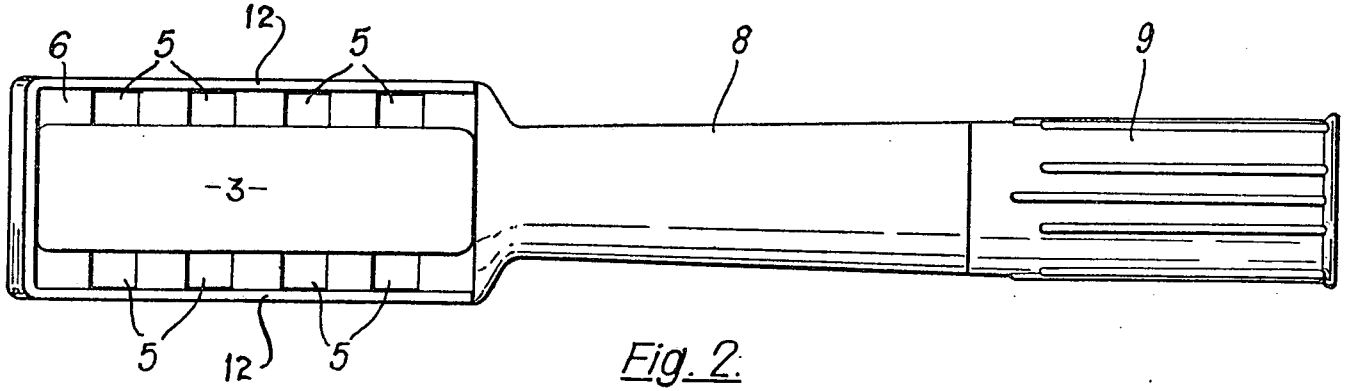
FIG. 2 is an underside elevation of the brush shown in FIG. 1 with the bristles omitted for clarity.

Referring to FIGS. 1 and 2 of the drawings, these show a dog-brush 1 having a head 2 with a base portion 3 supporting a set of bristles 4.

The head 2 is hollow and of generally rectangular cross-section, and a number of vacuum inlet passages 5 are formed in the marginal edge regions 6 of the base 7 around the outer periphery of the bristles. These passages 5 communicate with the interior of the head 2.

The brush includes a handle 8 which is fixed at one end to the head 2 and which is provided at its other end with a connection 9 to which the hose of a domestic vacuum cleaner may be attached. The handle 8 is formed with an axial bore 10 which communicates with the interior of the head 2 at 11. The sides of the brush head extend downwardly in the same direction as the bristles to form a short skirt 12 on the outside of the vacuum inlet passages 5.

In operation, the connection 9 of the handle 8 is attached to the hose of a vacuum cleaner and the brush used in the normal way on the coat of a dog. The openings 5 create a suction effect around the bristles and in operation the brush draws hair, dust and dirt through the brush head into the bag of the vacuum cleaner. The disposition of the vacuum passages around the outside of the bristles (and not amongst the bristles) has been found to prevent long hair tangling in the bristles and entering the vacuum passages, and in breeds where a good undercoat is essential, the undercoat is not damaged or removed; only the dead hair comes away. The action of the vacuum brush is to gently lift the coat of the dog and give a simultaneous grooming and cleaning action.

Figure 3:
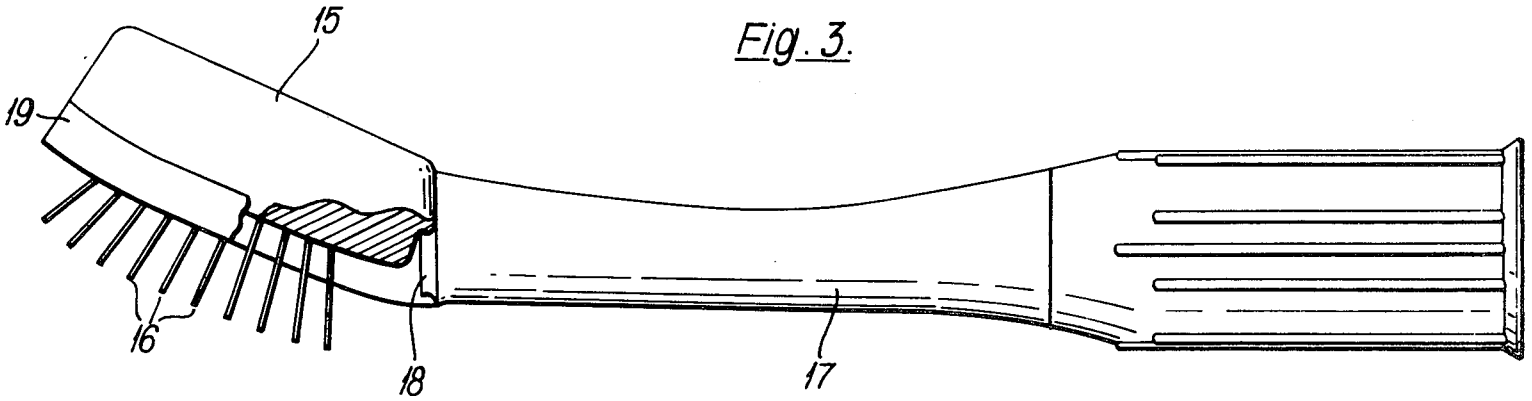
FIG. 3 is a side elevation of another dog brush with portions of the head omitted for clarity.

Another embodiment of vacuum brush suitable for grooming a dog is shown in FIG. 3. In this embodiment the head of the brush 15 is solid and is provided with a set of wire bristles 16. The handle 17 is hollow and suction is provided around the bristles by means of a suction pipe 18 which is integral with the handle and arranged adjacent the bristles to provide suction around the bristle when the brush is in use. A peripheral skirt 19 extends downwardly from the head 15 so that the vacuum inlet passage is formed around the bristles between the bristles and the skirt. This skirt may be formed integrally with the brush head and may be made of a flexible material, such as natural rubber. Portions of this skirt are omitted for clarity in FIG. 3. If the brush is to be used for grooming dogs, it is preferable that the brush head should be inclined to the brush handle as shown in FIG. 3 of the drawings, as this facilitates the grooming operation.

As a number of different types of bristles may be required for different purposes, it will be appreciated that a construction which allows different sets of bristles to be interchanged on one head possesses certain advantages in terms of both cost and convenience. Such a construction is shown in FIGS. 4 and 5.

Figure 4:
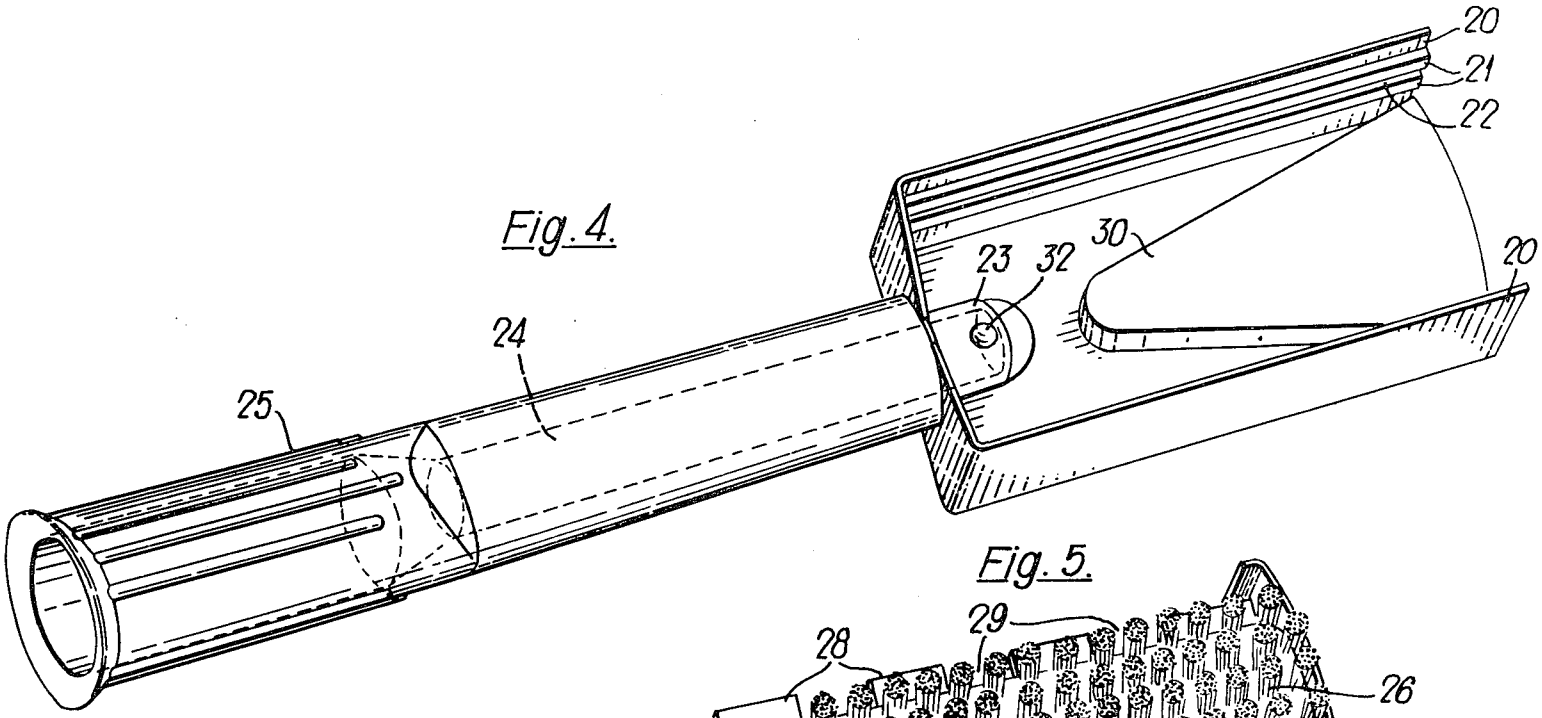
FIG. 4 is a perspective view of the underside of another dog brush, with the bristle support removed.
Figure 5:
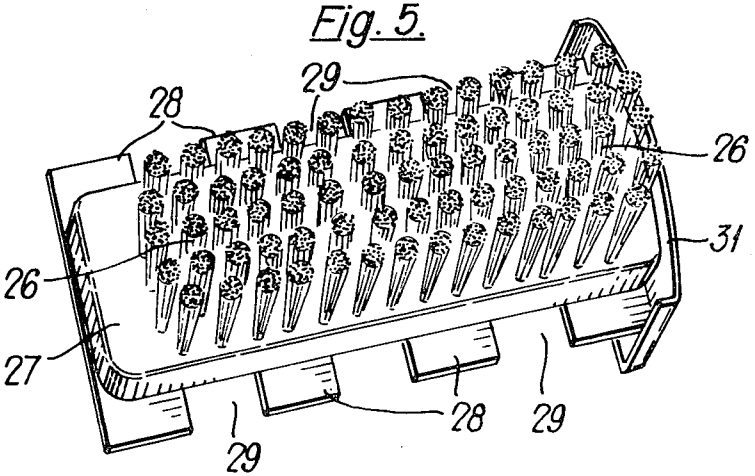
FIG. 5 is a perspective view of the underside of a bristle support suitable for use with the brush shown in FIG. 4.

In FIGS. 4 and 5, the head is provided with a vacuum inlet duct 23 communicating with a bore 24 formed in the brush handle 25. The inside walls of the sides 20 of the brush head are provided with parallel guides 21 which define between them slots 22, and the bristles 26 are supported on and extend from a removable bristle holder 27, the edge portions 28 of which are engageable in the slots 22 for location of the holder in the head 1. The holder 27 is provided with vacuum inlet slots 29, which communicate with the interior of the head when the holder is mounted in the brush.

The upper parts of the sides 20 form a skirt extending in the same direction as the bristles and the vacuum inlet slots 29 are located between this skirt and the bristles 26; an elevated portion 30 is provided in the brush head to promote a venturi effect in the air flow in the interior of the head. In an alternative embodiment, this elevated portion is omitted.

The holder 27 has an end face 31 which is of the same configuration as the open end of the brush head; this face 31 acts as an end closure when the holder 27 is fitted into the head. Suitable sealing means may be provided around the end of the brush head and the closure to minimise loss of vacuum due to leakage. The holder is retained in the head by a raised dimple 32, which is formed on the vacuum inlet duct 23 and which engages with a corresponding recess (not shown) formed in the holder 27. In order to fit the bristle holder into the head, the end of the holder remote from the end face 31 is engaged with slots 22, and the holder is pressed into position in the head; the holder is fully in position when the dimple 32 engages the recess.

Although the holder 27 is shown as being retained in the brush head by the guides 21, any suitable fixing means may be provided, for example the bristles may be on a flexible support and may be a push fit in the head, or the support may be secured with a threaded bolt or screw.

I claim;

1. A vacuum grooming brush comprising a brush head having walls defining an enclosed vacuum chamber, a hollow handle integral with the brush head communicating at one end with the vacuum chamber and at the other end being adapted for connection to a domestic vacuum cleaner, a set of bristles extending from one wall of the brush head, said bristles being arranged in rows extending substantially parallel to the longitudinal axis of the brush head and the handle, vacuum inlet passages formed in said one wall of the brush head located only in the marginal edge regions of said one wall between the bristles and the other edges of the head on two opposite longitudinally-extending sides thereof, said passages communicating with the interior of the vacuum chamber, and flow equalization means located within the vacuum chamber adapted to equalize the flow of air through said vacuum inlet passages over their longitudinal extension, said flow equalization means comprising a wedge -shaped relief portion formed in the upper wall of the brush opposite to said one wall, and extending into the vacuum chamber, the longitudinal axis of said wedge-shaped relief portion being co-axial with the longitudinal axis of the brush and the apex of said relief portion being directed towards the outlet from the vacuum chamber formed by the interior of said hollow handle.

2. A vacuum grooming brush according to claim 1, wherein the said one wall of the brush head which supports the bristles is provided around at least part of its periphery with a skirt extending in substantially the same direction as the bristles, and the vacuum inlet passages are located in the zones between the skirt and the bristles.

3. A vacuum grooming brush according to claim 1, wherein the said one wall of the brush head which supports the bristles is detachable from the remainder of the brush head.

* * * * *